US011859514B2

(12) United States Patent
Jörgensson et al.

(10) Patent No.: US 11,859,514 B2
(45) Date of Patent: Jan. 2, 2024

(54) ROTOR ARRANGEMENT FOR A ROTOR OF A GAS TURBINE

(71) Applicant: Siemens Energy Global GmbH & Co. KG, Munich (DE)

(72) Inventors: Otto Jörgensson, Norrköping (SE); Janos Szijarto, Finspong (SE)

(73) Assignee: Siemens Energy Global GmbH & Co. KG, Munich (DE)

( * ) Notice: Subject to any disclaimer, the term of this patent is extended or adjusted under 35 U.S.C. 154(b) by 0 days.

(21) Appl. No.: 18/105,850

(22) Filed: Feb. 5, 2023

(65) Prior Publication Data

US 2023/0258096 A1 Aug. 17, 2023

(30) Foreign Application Priority Data

Feb. 17, 2022 (EP) ..... 22157175

(51) Int. Cl.

| | |
|---|---|
| ***F01D 5/30*** | (2006.01) |
| ***F01D 5/32*** | (2006.01) |
| ***F04D 29/34*** | (2006.01) |
| ***F04D 29/32*** | (2006.01) |

(52) U.S. Cl.

CPC ..... *F01D 5/3015* (2013.01); *F01D 5/3007* (2013.01); *F01D 5/326* (2013.01); *F04D 29/322* (2013.01); *F04D 29/34* (2013.01)

(58) Field of Classification Search

CPC ..... F01D 5/3007; F01D 5/32; F01D 5/323; F01D 5/326; F01D 5/3015; F04D 29/322; F04D 29/34

See application file for complete search history.

(56) References Cited

U.S. PATENT DOCUMENTS

| | | | | |
|---|---|---|---|---|
| 3,656,865 | A * | 4/1972 | Spears, Jr. | F01D 5/3015 416/221 |
| 4,444,544 | A | 4/1984 | Rowley | |
| 5,052,893 | A * | 10/1991 | Catte | F01D 5/3015 416/221 |
| 2009/0116965 | A1 | 5/2009 | Brillert | |
| 2009/0136349 | A1 * | 5/2009 | Dezouche | F01D 5/3015 416/219 R |
| 2020/0056485 | A1 | 2/2020 | Shemyatovskiy | |

FOREIGN PATENT DOCUMENTS

WO 2007028703 A1 3/2007

* cited by examiner

*Primary Examiner* — Christopher Verdier

(74) *Attorney, Agent, or Firm* — Wolter Van Dyke Davis, PLLC

(57) ABSTRACT

A rotor arrangement for a rotor of a gas turbine includes at least one rotor disk with attachment slots for carrying rotor blades and an annular groove having an annular opening towards the outward direction; and rotor blades having an airfoil and a blade root and assembled in an attachment slot. Each of the assembled blade roots have a root extension with a root groove. The root groove faces the annular groove when the rotor blade is assembled in the attachment slot. For each assembled rotor blade a locking element is provided, the locking element engaging the annular groove of the rotor disk and the root groove of the respective rotor blade. Preferably all locking elements are embodied as a locking sheet metal strip, which has two bended tongues embracing the respective root extension.

7 Claims, 4 Drawing Sheets

ROTOR ARRANGEMENT FOR A ROTOR OF A GAS TURBINE

CROSS REFERENCE TO RELATED APPLICATIONS

This application claims the benefit of European Application No. EP22157175 filed 17 Feb. 2022, incorporated by reference herein in its entirety.

FIELD OF THE INVENTION

The invention relates to a rotor arrangement for a rotor of a gas turbine and in detail to an axial locking of rotor blades attached to a rotor disk.

BACKGROUND TO THE INVENTION

Modern gas turbines often comprise a rotor having multiple turbine disks and compressor disks that are stacked along and tied together by a central tie bolt. At the rim of those disks, which are also known as rotor disks, compressor blades and turbine blades are attached. For the attachment the rotor disks are equipped with multiple attachment slots that extend in the axial direction of the disk. The attachment slots are of dovetail shape or fir-tree shape, so that the correspondingly shaped roots of the compressor blades or turbine blades are carried securely. Further, to ensure a fixed axial positioning of the rotor blades within the attachment slots, a locking assembly is arranged at the upstream or downstream side of the rotor disk accordingly.

Such an arrangement is shown in U.S. Pat. No. 4,444,544 A. In accordance with this document the locking assembly comprises two opposingly arranged grooves. One of the two grooves is arranged in the rotor disk whereas the other is arranged in the turbine blade root. A solid pin engages the opposingly arranged grooves for prohibiting any axial movement of the blade along its slot. However, a solid pin adds much weight to the rotor blades, and with that during operation a higher stress into the rotor blade roots. Further, it requires a higher bending force for assembly.

With that, it is an objective of the invention to provide a simple rotor arrangement which is easy to assemble and which, when operated, creates reduced stress on rotor blades.

SUMMARY OF THE INVENTION

Accordingly, the present invention provides a rotor arrangement for a rotor of a gas turbine, comprising—at least one rotor disk comprising a plurality of axially extending attachment slots along its outer periphery for carrying rotor blades and a lateral surface with an annular groove having an annular opening towards the outward direction, the annular groove arranged radially inwardly of the attachments slots and—a plurality of rotor blades, wherein each rotor blade comprises an airfoil and a blade root, each rotor blade is assembled with its blade root in one of the plurality of the attachment slots, wherein each of the assembled blade roots comprises a root extension with a root groove, said root groove facing the annular groove when the rotor blade is assembled in the attachment slot, and wherein for each assembled rotor blade a locking element is provided, which locking element engaging the annular groove of the rotor disk and the root groove of the respective rotor blade, and wherein at least one of the locking elements is, preferably all locking elements are embodied as a locking sheet metal strip, which comprises two bended tongues embracing the respective root extension.

Due to the inventive matter of having a metal sheet strip as a locking element instead of a solid pin, the weight added to the rotor blades can be reduced, and the bending of the locking element can be achieved with reduced bending force.

A rotor disk is intended to mean a compressor disk or turbine disk carrying on its outer rim either compressor rotor blades or turbine rotor blades.

In this application the terms "radial", "axial" and "tangential" relate to the rotational axis about which the rotor arrangement will rotate during its conventional operation.

According to an advantageous embodiment of the invention the locking sheet metal strip comprises a main body to which the two tongues are attached, the two tongues are bent around a radially extending bending edge to embrace the root extension of the corresponding rotor blade. This arrangement is achieved through bending the lateral tongues around a bending edge, which extends in radial direction. As the bending edge extends radially, centrifugal forces acting onto the lateral tongues cannot bend the tongues back. This leads to reliable and safe construction from an operational perspective.

According to another preferred embodiment of the invention, the annular groove, and the root groove each have an axial groove width, wherein the respective locking sheet metal strip comprises a C-shaped inner end and a C-shaped outer end, each comprising an axial width that corresponds to the respective axial groove width. This leads to an improved axial fixation of the rotor blade within its attachment slot in comparison to a locking sheet metal strip having only plane inner and outer ends.

According to an alternative arrangement of the invention a thickening element TE can be attached, e.g., by welding, brazing or the like, onto the locking sheet metal strip. This enables easier manufacture of a locking sheet metal strip in the situation, when, because of rather small size of the locking sheet metal strip, the bending of the outer and inner ends is difficult or impossible.

According to a preferred realisation of the invention the locking sheet metal strip has a constant sheet thickness. This enables an inexpensive and easy to manufacture locking sheet metal strip.

BRIEF DESCRIPTION OF THE DRAWINGS

The present invention will be described with reference to drawings in which.

DETAILED DESCRIPTION

In all figures identical features are identified with the same reference numbers.

Figure 1:
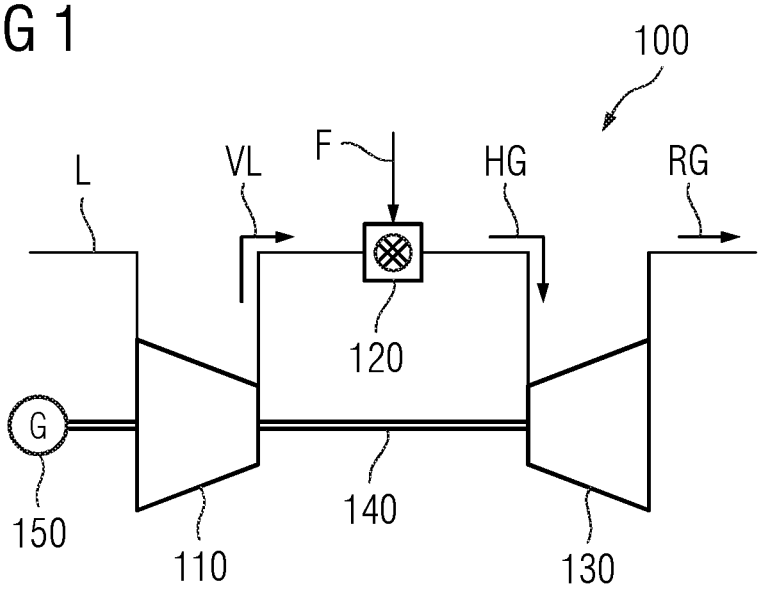
FIG. 1 shows schematically a gas turbine.

FIG. 1 shows schematically a gas turbine 100 with a compressor 110, a combustion chamber 120 and a turbine unit 130. The compressor 110 and the turbine unit 130 each comprise stationary parts and rotary parts (not shown in FIG. 1). According to this exemplary embodiment, an electrical generator 150 for generating electricity is coupled to a rotor 140 of the gas turbine. During operation the axial compressor 110 sucks in ambient air L and conveys it as compressed air VL to its outlet and further to the combustion chamber 120. Here, the compressed air VL is mixed with fuel F and burned to a hot gas HG. In the turbine unit 130 the hot gas HG is expanded. After the expansion the gas leaves the turbine unit 130 as flue gas RG. The expansion of the hot gas HG generates torque on rotor 140 in the turbine unit 130, which then drives the compressor 110 and the generator 150.

Figure 2:
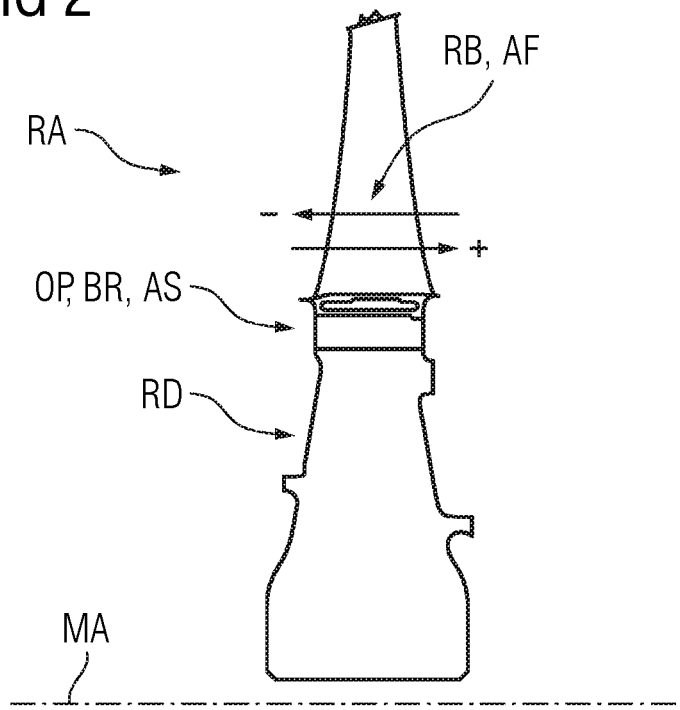
FIG. 2 shows an axial sectional view of a rotor disk with a rotor blade.
Figure 3:
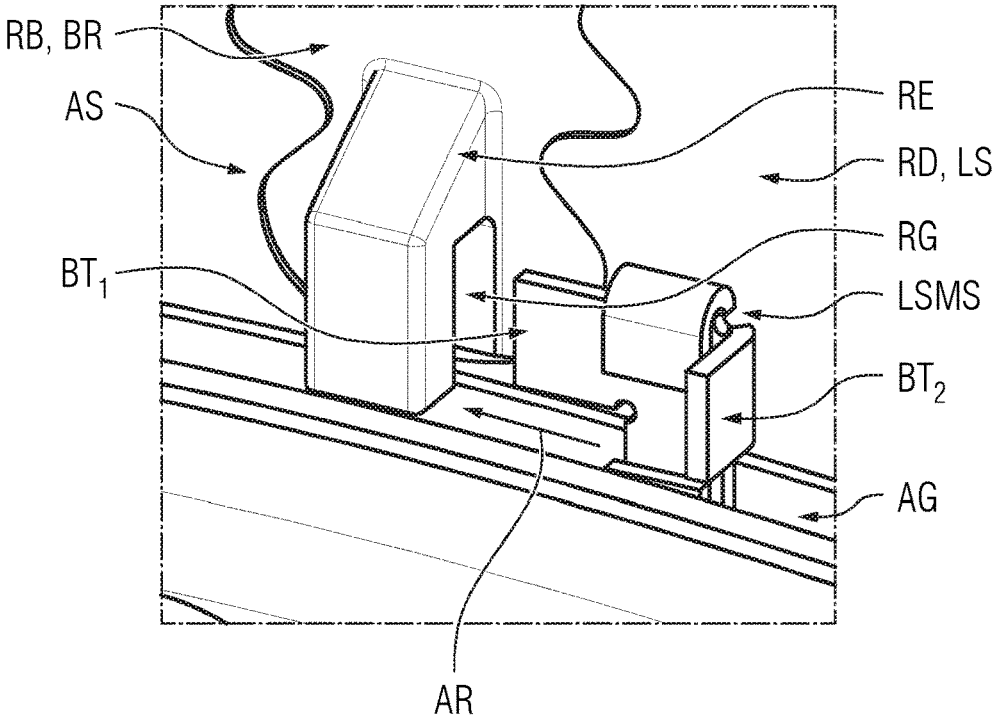
FIG. 3 shows a perspective view onto an outer periphery of a rotor disk before assembly of a locking sheet metal strip.

The rotor 140 comprises as rotary parts several rotor disks of which in FIG. 2 only one rotor disk RD is displayed. On the rotor disk RD, a number of rotor blades RB are attached to the rotor disk RD, of which only one is shown again. Each rotor blade RB comprises an airfoil AF and a blade root BR. For attaching the rotor blades RB onto the rotor disk RD, the rotor disk RD comprises at its outer periphery OP a number of attachment slots AS (FIG. 3). Herein the blade roots BR of rotor blades RB are firmly engaged. When the rotor arrangement RA is assembled within the rotor 140 of the gas turbine 100, the rotor 140 and the rotor disk RD is able to rotate around the machine axis MA.

FIG. 3 is a perspective view onto the rotor arrangement RA and especially onto the lateral surface LS of the rotor disk RD, before assembly of a locking sheet metal strip LSMS. The rotor disk RD comprises at its lateral surface LS an annular groove AG having an annular opening directed in radially outwardly. The lateral surface LS could be either the lateral surface of the upstream side or the downstream side of the rotor disc RD, wherein upstream and downstream are to be determined in reference to the flow direction of the working medium of the compressor or turbine.

Radially outwardly relative to the annular groove AG and with rather small distance thereto a number of attachment slots AS are arranged at the outer periphery of the rotor disk RD. In FIG. 3 only one of the attachment slots is shown. In the attachment slot AS the blade root BR of the rotor blade RB is arranged. Both the attachment slot AS and the blade root BR are shaped complementarily, such that during operation and rotation of the rotor arrangement RA the rotor blades RB are securely attached to the rotor disk RD. According to this exemplary embodiment of the invention, the attachment slot AS and the blade root BR are of fir-tree shape. A front side of the blade root BR is flush with the lateral surface of the rotor disk RD. From said front side a root extension RE protrudes. The root extension RE comprises a root groove RG having an opening towards the machine axis MA. Hence, the root extension RE is embodied as a hook projecting inwardly in such a way, that the opening of the root groove RG and the opening of the annular groove AG are opposingly arranged with flush walls (FIG. 6).

In the final rotor arrangement RA (FIGS. 5 and 6) the locking sheet metal strip LSMS engages simultaneously the root groove RG and the annular groove AG.

Figure 6:
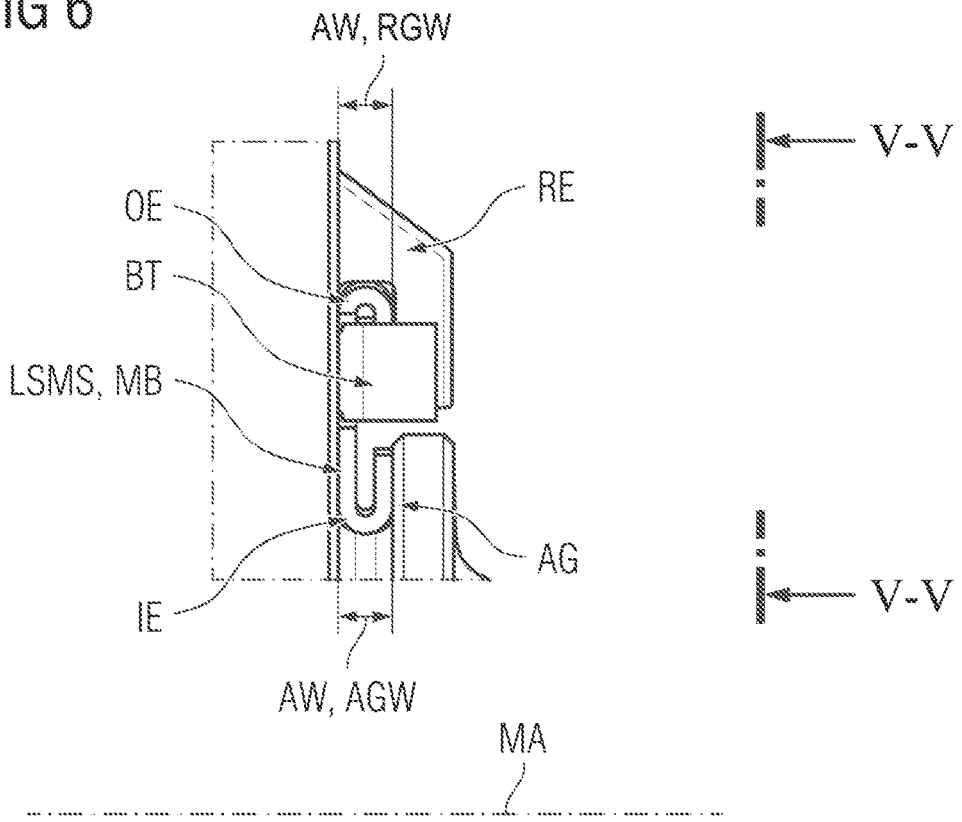
FIG. 6 shows an axial sectional view through FIG. 5.

The locking sheet metal strip LSMS according to the first exemplary embodiment of the invention comprises, as shown in detail in FIG. 6, a C-shaped outer end OE and a C-shaped inner end IE as well as two lateral tongues BT, all extending from a main body MB of the locking sheet metal strip LSMS in all four directions. The tongues are, for example, rectangularly shaped. One of the lateral tongues BT, in FIG. 3 identified by index 1, extends in the same plane as the main body MB of the locking sheet metal strip LSMS, whereas the other lateral tongue BT, in FIG. 3 identified by index 2, is bent. In this regard bent means that the respective tongue extends perpendicular to the plane of the main body MB of the locking sheet metal strip LSMS.

Figure 4:
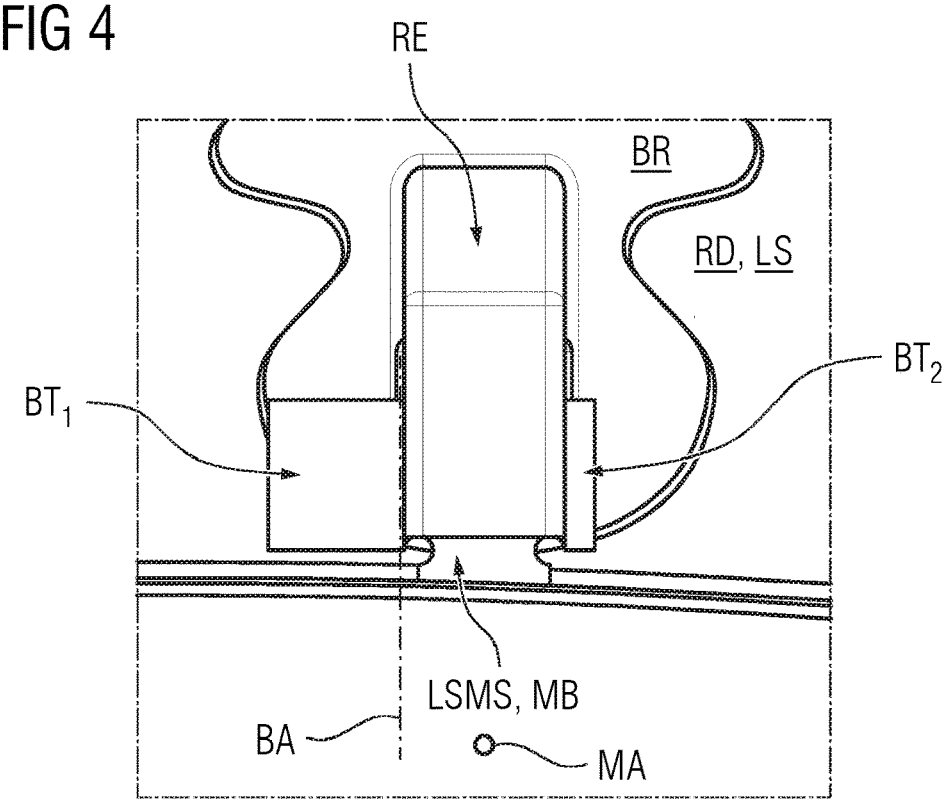
FIG. 4 shows a plan view on the outer periphery of the rotor disk during the assembly of the locking sheet metal strip.
Figure 5:
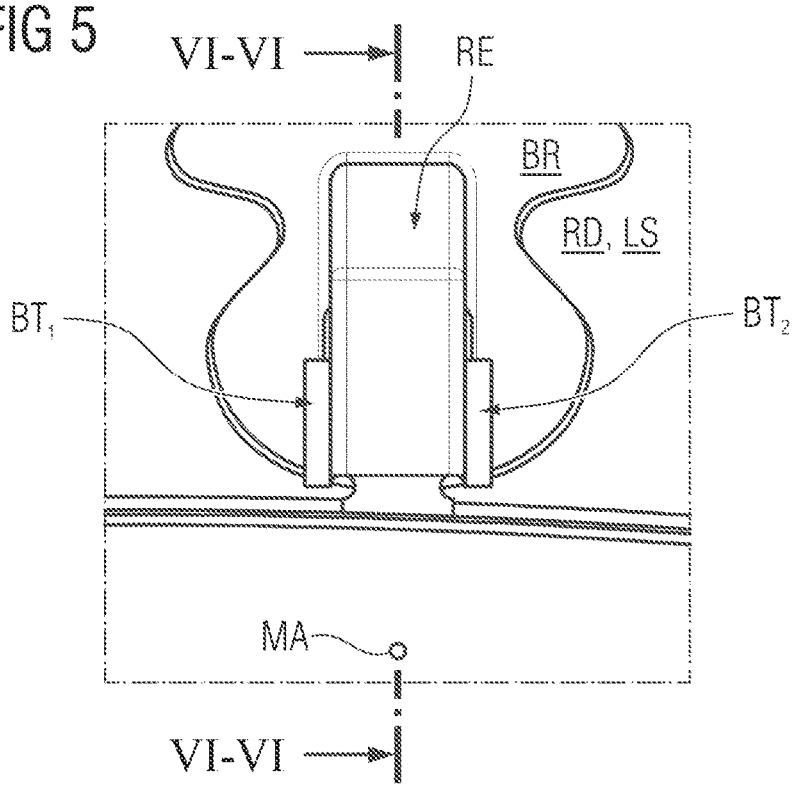
FIG. 5 shows a plan view on the outer periphery of the rotor disk after final assembly of the locking sheet metal strip.

During its assembly, the locking sheet metal strip LSMS is moved as shown by arrow AR along the annular groove AG until the lateral tongue $BT_2$ contacts root extension RE. The final position of the locking sheet metal strip is shown in FIG. 4 as plain view onto the rotor arrangement RA. If needed, the locking sheet metal strip LSMS can be fixed temporarily in this position for securing its position during the following bending of the lateral tongue $BT_1$ around the bending axis BA. At the beginning of the bending process the required bending force is directed in the axial direction. With continued bending the bending force turns more and more into the tangential direction. The bending of the lateral tongue $BT_1$ around the bending axis BA is completed when it contacts the root extension RE in a planar manner, as shown in FIG. 5, or with a small gap therebetween. Because of the constant, rather small sheet thickness of the locking sheet metal strip LSMS, a rather small bending force is needed to bring the lateral tongue $BT_1$ in its final position. In this position, the locking sheet metal strip LSMS is securely attached to the rotor disk and to the blade root. On other words, the locking sheet metal strip LSMS embraces and/or clamps the root extension RE in a manner which blocks its movement along the annular groove AG in tangential direction.

As can be seen in FIG. 6 the axial width AGW of the annular groove AG, the axial width RGW of the rotor groove RG and the corresponding widths AW of the C-shaped outer end OE and the C-shaped inner end IE of the locking sheet metal strip LSMS are shown. The sizes of all axis widths AGW, RGW, AW are identical to ensure ease of manufacture and assembly and an accurate, clearance-free fit. With that, any axial movement of the respective rotor blade RB, in detail the blade root BR, along the attachment slot AS is avoided, which provides accurate axial positioning of the rotor blade leading to predefined radial gaps between the tip of its airfoil and the opposingly arranged flow path boundary of the compressor resp. turbine.

Figure 7:
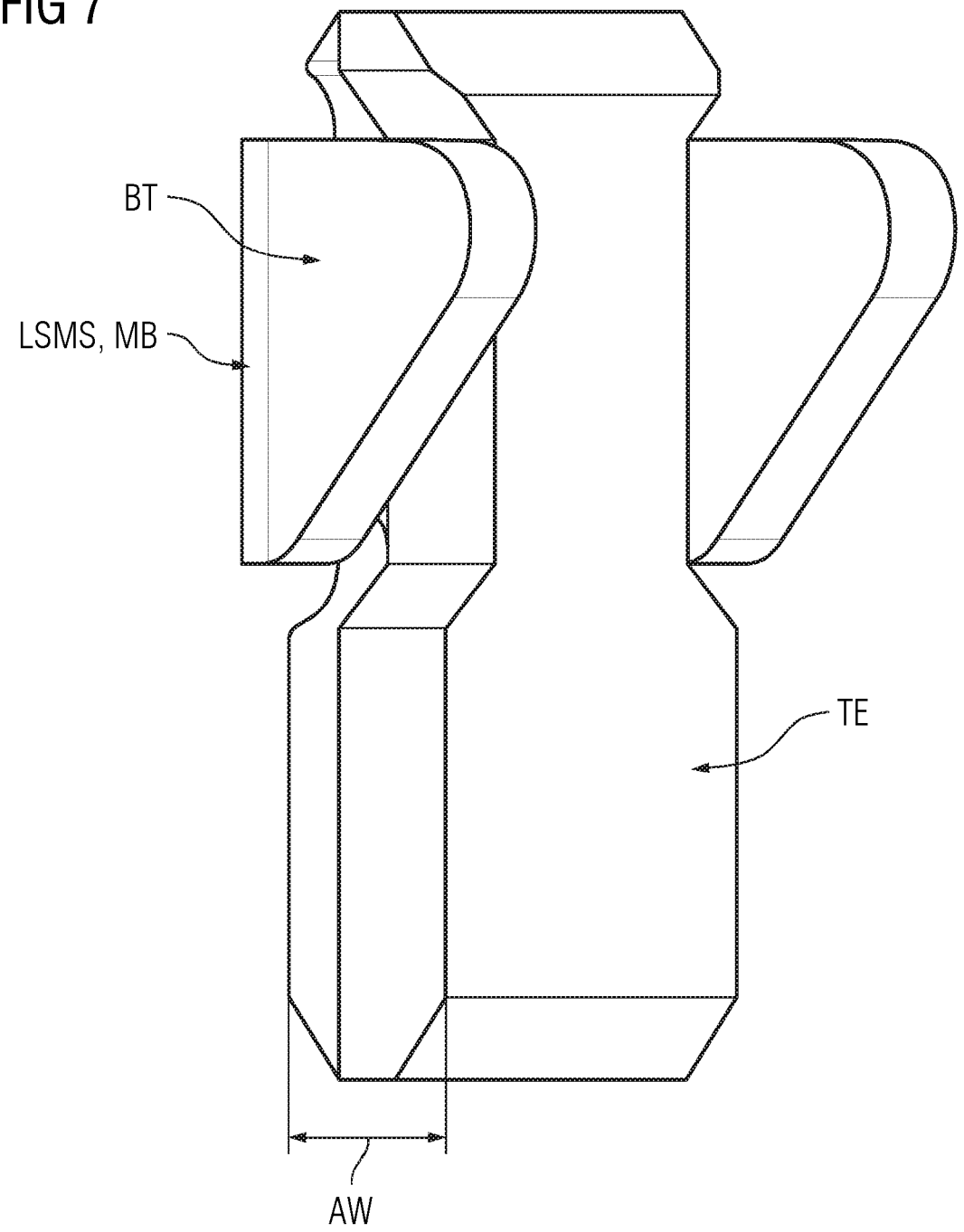
FIG. 7 shows a perspective view onto a locking sheet metal strip according to a second exemplary embodiment.

Instead of having C-shaped inner ends and C-shaped outer ends and still for achieving the required axial width AG, a thickening element TE can be firmly attached, e.g., by welding, brazing or the like, onto the locking sheet metal strip LSMS, as shown in FIG. 7 as a second exemplary embodiment of the invention. This enables easier manufacture, when, because of rather small size of the locking sheet metal strip, the bending of the outer and inner ends is difficult. According to this exemplary embodiment, the tongues that are bent around the bending axis BX, are of triangular shape.

In summary the invention relates to a rotor arrangement RA comprising a rotor arrangement RA for a rotor 140 of a gas turbine 100, comprising—at least one rotor disk RD comprising attachment slots for carrying rotor blades RB and an annular groove AG having an annular opening towards the outward direction and—rotor blades RB having an airfoil AF and a blade root BR and assembled in an attachment slot AS, wherein each of the assembled blade roots BR comprises a root extension RE with a root groove RG, said root groove RG facing the annular groove AG when the rotor blade RB is assembled in the attachment slot AS, and wherein for each assembled rotor blade RB a locking element is provided, which locking element engaging, the annular groove AG of the rotor disk RD and the root groove RG of the respective rotor blade RB. For the provision of a light and an easy mountable locking element preferably all locking elements are embodied as a locking sheet metal strip LSMS, which comprises two bended tongues BT embracing the respective root extension RE.

The invention claimed is:

1. A rotor arrangement (RA) for a rotor of a gas turbine, comprising at least one rotor disk (RD) comprising a plurality of axially extending attachment slots (AS) along its outer periphery (OP) for carrying rotor blades (RB) and a lateral surface (LS) with an annular groove (AG) having an annular opening towards the outward direction, the annular groove (AG) being arranged radially inwardly of the attachments slots (AS) and a plurality of rotor blades (RB), wherein each rotor blade (RB) comprises an airfoil (AF) and a blade root (BR), each rotor blade (RB) is assembled with its blade root (BR) in one of the plurality of the attachment slots (AS), wherein each of the assembled blade roots (BR) comprises a root extension (RE) with a root groove (RG), said root groove (RG) facing the annular groove (AG) when the rotor blade (RB) is assembled in the attachment slot (AS), and wherein for each assembled rotor blade (RB) a locking element is provided, a main body of the locking element engaging the annular groove (AG) of the rotor disk (RD) and the root groove (RG) of the respective rotor blade (RB), characterized in that at least one of the locking elements is embodied as a locking sheet metal strip (LSMS), which comprises the main body (MB) and two lateral tongues (BT), the two lateral tongues (BT) extending axially from the main body, thereby embracing the respective root extension (RE), and wherein the two lateral tongues (BT) are each bent around a respective radially extending bending axis (BA) to thereby embrace the root extension (RE) of the corresponding rotor blade (RB).

2. Rotor arrangement (RA) according to claim 1, wherein the annular groove (AG) and the root groove (RG) each having an axial groove width (AGW), wherein the respective locking sheet metal strip (LSMS) comprises a C-shaped inner end (IE) and a C-shaped outer end (OE) each comprising an axial width (AW) that corresponds to the respective axial groove width (AGW).

3. Rotor arrangement (RA) according to claim 1, wherein a thickening element (TE) is attached onto the locking sheet metal strip (LSMS).

4. Rotor arrangement (RA) according to claim 1, wherein the locking sheet metal strip (LSMS) has a constant sheet thickness.

5. A gas turbine (100) comprising one or more rotor assemblies (RA) in accordance with claim 1.

6. A rotor arrangement (RA) for a rotor of a gas turbine, comprising at least one rotor disk (RD) comprising a plurality of axially extending attachment slots (AS) along its outer periphery (OP) for carrying rotor blades (RB) and a lateral surface (LS) with an annular groove (AG) having an annular opening towards the outward direction, the annular groove (AG) being arranged radially inwardly of the attachments slots (AS) and a plurality of rotor blades (RB), wherein each rotor blade (RB) comprises an airfoil (AF) and a blade root (BR), each rotor blade (RB) is assembled with its blade root (BR) in one of the plurality of the attachment slots (AS), wherein each of the assembled blade roots (BR) comprises a root extension (RE) with a root groove (RG), said root groove (RG) facing the annular groove (AG) when the rotor blade (RB) is assembled in the attachment slot (AS), wherein for each assembled rotor blade (RB) a locking element is provided, the locking element engaging the annular groove (AG) of the rotor disk (RD) and the root groove (RG) of the respective rotor blade (RB), characterized in that at least one of the locking elements is embodied as a locking sheet metal strip (LSMS), which comprises a main body (MB) and two lateral tongues (BT), the two lateral tongues (BT) embracing the respective root extension (RE), and wherein the annular groove (AG) and the root groove (RG) each having an axial groove width (AGW), wherein the respective locking sheet metal strip (LSMS) comprises a C-shaped inner end (IE) and a C-shaped outer end (OE) each comprising an axial width (AW) that corresponds to the respective axial groove width (AGW).

7. A rotor arrangement (RA) for a rotor of a gas turbine, comprising at least one rotor disk (RD) comprising a plurality of axially extending attachment slots (AS) along its outer periphery (OP) for carrying rotor blades (RB) and a lateral surface (LS) with an annular groove (AG) having an annular opening towards the outward direction, the annular groove (AG) being arranged radially inwardly of the attachments slots (AS) and a plurality of rotor blades (RB), wherein each rotor blade (RB) comprises an airfoil (AF) and a blade root (BR), each rotor blade (RB) is assembled with its blade root (BR) in one of the plurality of the attachment slots (AS), wherein each of the assembled blade roots (BR) comprises a root extension (RE) with a root groove (RG), said root groove (RG) facing the annular groove (AG) when the rotor blade (RB) is assembled in the attachment slot (AS), wherein for each assembled rotor blade (RB) a locking element is provided, a main body of the locking element engaging the annular groove (AG) of the rotor disk (RD) and the root groove (RG) of the respective rotor blade (RB), characterized in that at least one of the locking elements is embodied as a locking sheet metal strip (LSMS), which comprises the main body (MB) and two lateral tongues (BT), the two lateral tongues (BT) extending axially from the main body, thereby embracing the respective root extension (RE), and wherein the annular groove (AG) and the root groove (RG) each having an axial groove width (AGW), wherein the respective locking sheet metal strip (LSMS) comprises a C-shaped inner end (IE) and a C-shaped outer end (OE) each comprising an axial width (AW) that corresponds to the respective axial groove width (AGW).

* * * * *